US005207627A

United States Patent [19]

Doran

[11] Patent Number: 5,207,627

[45] Date of Patent: May 4, 1993

[54] DEVICE FOR DECOMPRESSING THE SPINE AND METHOD

[76] Inventor: Guy R. Doran, 299 California Ave., Ste. 200, Palo Alto, Calif. 94306

[21] Appl. No.: 735,820

[22] Filed: Jul. 25, 1991

[51] Int. Cl.[5] ..... A63B 21/02

[52] U.S. Cl. ..... 482/124; 482/114; 482/139

[58] Field of Search ..... 272/139, 143, 903, 126, 272/128, 116, 137, 135, 138; 128/71, 75; 482/91, 114, 131, 121, 122, 123, 124, 139

[56] References Cited

U.S. PATENT DOCUMENTS

| | | | |
|---|---|---|---|
| 1,280,987 | 10/1918 | Gregory | 128/71 |
| 2,280,274 | 4/1942 | Wildermuth . | |
| 3,940,144 | 2/1976 | Dickie | 272/126 |
| 4,441,707 | 4/1984 | Bosch | 482/131 |
| 4,735,412 | 4/1988 | Prsala | 272/139 |
| 4,955,608 | 9/1990 | Dougherty et al. | 272/116 |
| 5,062,642 | 11/1991 | Berry et al. | 272/139 |

FOREIGN PATENT DOCUMENTS

| | | | |
|---|---|---|---|
| 1081419 | 12/1954 | France | 272/138 |

OTHER PUBLICATIONS

Stretch & Flex, Ponce, 1989, FIGS. 61 & 62.

Nada-Chair, "Give Your Back a Comfort Break", one duplex page advertisement.

*Primary Examiner*—Richard J. Apley
*Assistant Examiner*—Lynne A. Reichard
*Attorney, Agent, or Firm*—Aquilino & Welsh

[57] ABSTRACT

Device for decompressing the spine of the body of a human being having an elongate adjustable strap assembly and soft flexible pad secured to the strap assembly and adapted to be placed in engagement with the body of the human being in the vicinity of the lower portion of the back of the human being. The strap assembly can be formed in a closed loop and adjustable in length so that it can extend from the pad along the opposite sides of the body of the human and over another portion of the body of the human being below the knees of the human being. A cross member is provided which extends over the body of the human being on one side and in the region which is generally opposite that over which the flexible pad extends. The strap assembly can include means for engagement by the feet of the human being and the cross member and soft flexible pad can substantially encircle the body of the human being.

7 Claims, 4 Drawing Sheets

DEVICE FOR DECOMPRESSING THE SPINE AND METHOD

FIELD OF THE INVENTION

This invention relates to a device for decompressing the spine and a method for using the same to achieve the decompression of the spine.

DESCRIPTION OF RELATED ART

In Wildermuth U.S. Pat. No. 2,280,274 issued on Apr. 21, 1942 there is a disclosed a device which is utilized for manipulating and massaging vertebrae. In the device, a centrally located padded portion of a cross member engages the upper part of the back of the patient in a sitting position over which there passes a strap. The strap also passes down both sides of the patient and extends over the feet of the patient. A rigid cross bar extends between the straps extending down opposite sides of the patient and engages the knees just below the knees of the patient with the knees being bent in a slightly upward position. By holding a portion of the strap engaging the feet with one foot and exerting pressure with the other foot one side of the back member can apply forward and side pressure upon the spinal column. By moving the pad vertically along the spine and repeating this exercise, Wildermuth teaches that vertebrae are twisted with respect to the remaining vertebrae and may be drawn into alignment with the remainder of the spinal column. Wildermuth also points out that the direction of pull upon the back may be regulated by the position of the cross member upon the knees.

There is no teaching in Wildermuth as to how the device therein can be utilized for treating compression of the lower portion of the back of human beings. Typically in hospitals and physical therapy clinics attempts to alleviate the pain from such compression of the lower back have utilized traction devices. However, such devices have been complicated and expensive. In addition, they often require professional supervision. There is therefore a need for a new and improved device and method which can be utilized for decompressing the spine.

SUMMARY OF THE INVENTION

In general, it is an object of the present invention to provide a device for decompressing the spine of the body of a human being and a method for using the same to achieve such decompression.

Another object of the invention is to provide a device of the above character which is relatively simple and has an economical construction.

Another object of the invention is to provide a device which can be readily put into use.

Another object of the invention is to provide a device and method of the above character which can be utilized to stretch and elongate the spine which will help and/or relieve a "tired or tight" back condition.

Another object of the invention is to provide a device and method of the above character which can be utilized by athletes in sports to increase performance and prevent soft tissue injuries from strain, sprain injuries and injuries that occur from tight leg and back muscles caused by overuse or imbalances in strength of the muscles.

Another object of the invention is to provide a device and method of the above character which can be utilized as a medical orthopedic device to support care of the spine, sacrum and muscles involved in back pain.

Another object of the invention is to provide a device and method of the above character which can be utilized to correct, alleviate and prevent mechanical changes in the low back of the human being that produce symptoms and to give immediate relief to athletes who have tightness or mild discomfort after physical activity.

Additional objects and features of the invention will appear from the following description in which the preferred embodiments are set forth in conjunction with the accompanying drawings.

DESCRIPTION OF THE PREFERRED EMBODIMENT

In general, the preferred embodiment of the device for decompressing the spine of a body of a human being is comprised of an elongate adjustable flexible strap assembly forming a closed loop. A soft flexible pad is secured to the strap assembly and is adapted to be placed in engagement with the body of a human being in the vicinity of the lower portion of the back of the human being. The strap assembly has a sufficient length so that it can extend from the pad along opposite sides of the body and over another portion of the body below the knees of the human being. A cross member is provided which engages the strap assembly on opposite sides of the body and extends over the body on the side and in a region generally opposite that over which the flexible pad extends.

Figure 4:
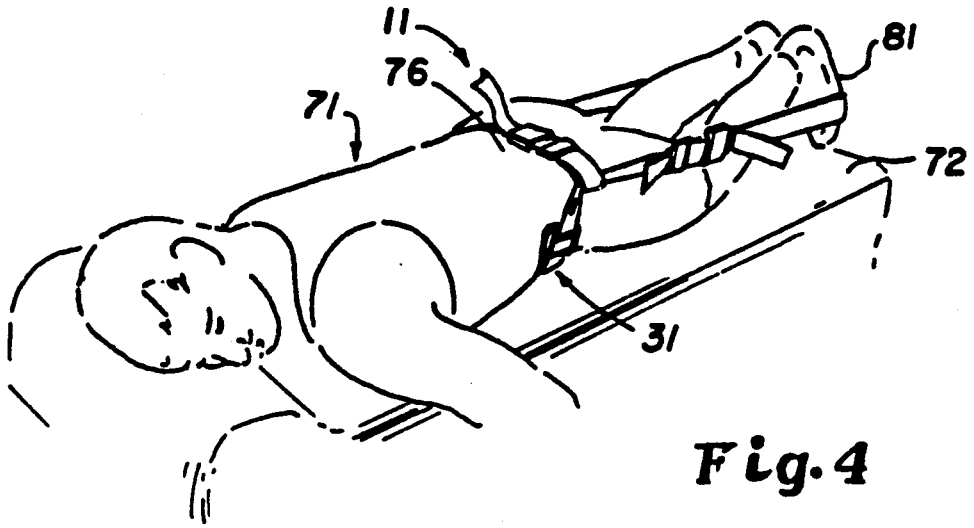
FIG. 4 is a perspective view showing the device being utilized on a human being in a supine face down position.
Figure 5:
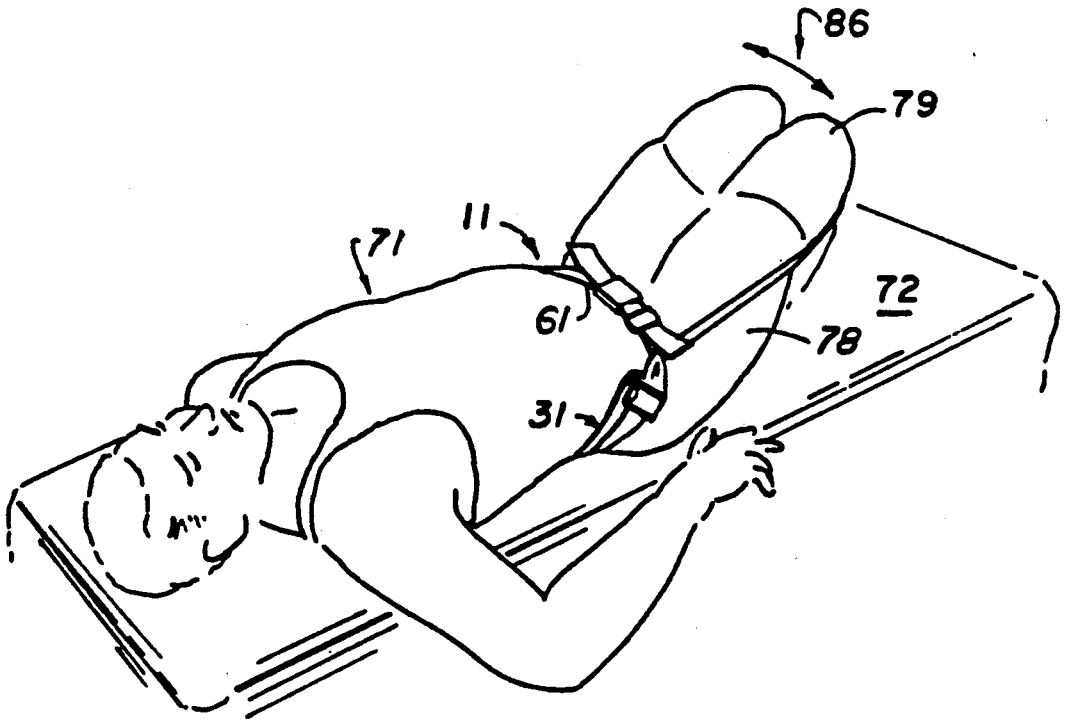
FIG. 5 is a perspective view showing the device being used on a human being in a face up supine position and engaging the bent knees.
Figure 6:
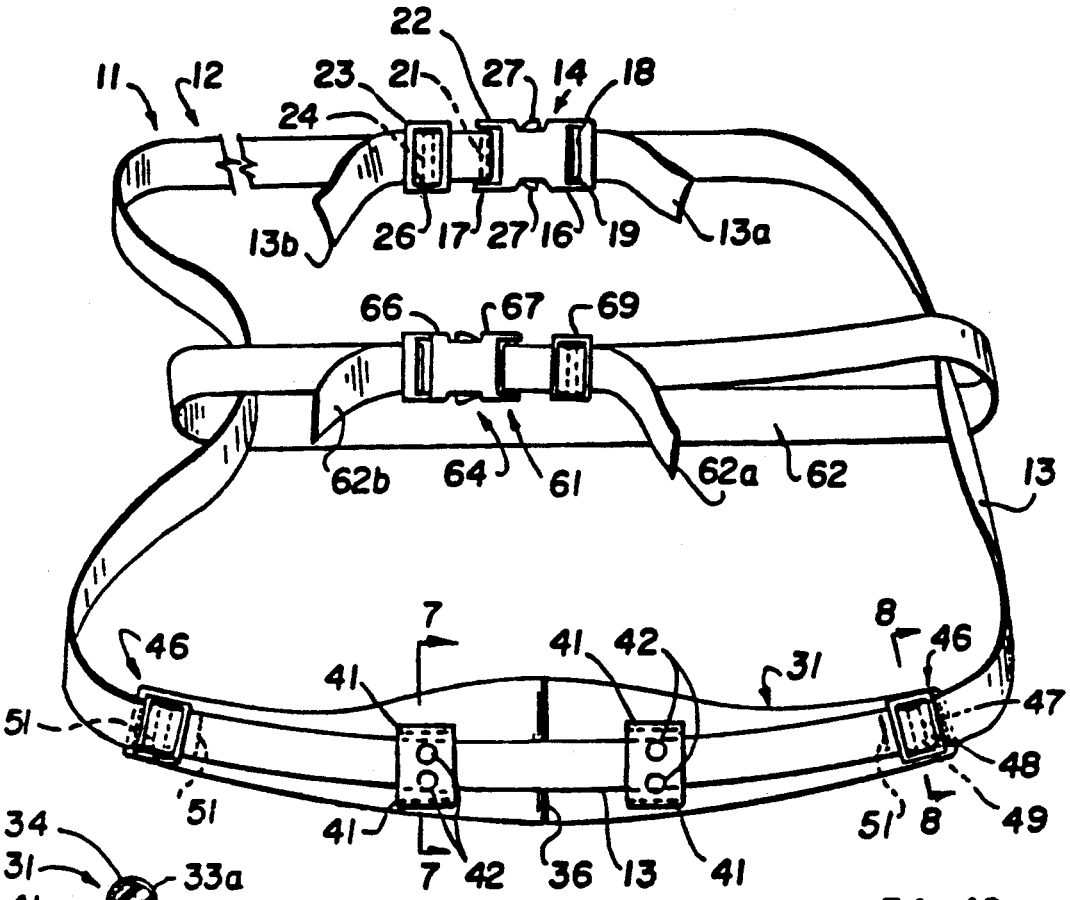
FIG. 6 is an isometric view showing the device which is utilized in FIGS. 1 through 5.
Figure 7:
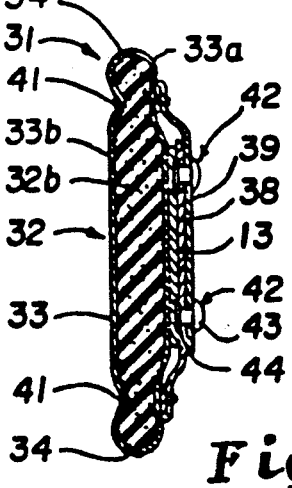
FIG. 7 is a cross-sectional view taken along the line 7—7 of FIG. 6.
Figure 8:
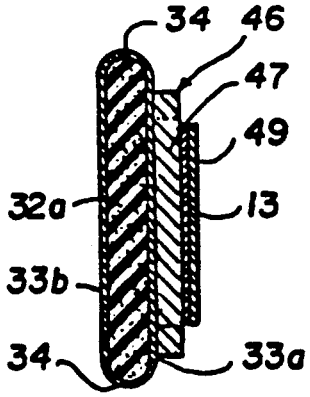
FIG. 8 is a cross-sectional view taken along the line 8—8 of FIG. 6.

More specifically as shown particularly in FIG. 6 of the drawings and also as illustrated in FIGS. 1 through 5, the preferred embodiment of the device 11 for decompressing the spine of the body of a human being consists of an elongate adjustable flexible strap assembly 12 which forms a closed loop. The strap assembly 12 consists of a flexible strap 13 formed of a suitable woven material such as NYLON fabricated into a strap having a suitable width as for example 2 inches and a suitable length as for example 72 inches. The length can vary considerably depending upon the height of the human beings to utilized the device. However typically for an adult human being, the strap should have a length ranging from 60 to 84 inches with a preferable length of approximately 72 inches. The strap 13 is provided with two ends 13*a* and 13*b* which are releasably fastened together by buckle means 14 of a suitable type such as a Fastex No. SR2 manufactured by ITW Nexus, Elk Grove, Ill. 60007. Such buckle means 14 consists of a male part 16 which is adapted to be inserted in a female part 17. The male part 16 is provided with a cross piece 18 extending across a rectangular recess 19 into which the end 13*a* of the strap is inserted. The female part 17 is provided with a cross piece 21 which extends across a N-shaped 22 and over which the end 13*b* is folded and is clamped in place by the use of another buckle 23 that is provided with a cross piece 24 extending across a rectangular opening 26. The male part 16 is provided with depressible fingers 27 which when depressed permit the male part 16 to be separated from the female part 17.

A soft flexible pad assembly 31 is secured to the strap assembly 12. The pad assembly 31 consists of a pad 32 formed of a suitable material such as foam rubber and has a fabric covering 33 of a suitable material such as NYLON. By way of example, to provide additional attractiveness to the device 11, the fabric covering 33 can be formed of two parts 33*a* and 33*b* which are sewn together at 34 at their upper and lower extremities with part 33*a* having a suitable color such as orange and the part 33*b* having a suitable color such as blue with the strap assembly 12 being black. The pad 32 is provided in two parts 32*a* and 32*b* with the fabric covering 33 covering each of the parts and with the inner margins of the fabric covering 33 being sewn together by a reinforcing strip 36 extending transversely of the pads 32*a* and 32*b* so as to facilitate packing of the pad assembly for shipment and storage.

Means is provided for securing the pad assembly 31 to the strap assembly 12 and consists of first and second flaps 38 and 39 adapted to extend over each other and which are sewn to the pads 32*a* and 32*b* and through the fabric covering 33 at 41. First and second snap assemblies 42 of a conventional type are secured to the two flaps 38 and 39 with the female part 43 being secured to the flap 39 and the male part 44 being secured to the flap 38. By utilization of these snap assemblies 42, the strap 13 can be inserted therebetween after which the snap assemblies 42 can be snapped together to retain the strap 13 therein. In addition to the pad assembly 31 being retained on the strap 13 by the flaps 38 and 39 there is provided a buckle 46 at each end of the pad 32. Each of the buckles 46 is provided with a cross piece 47 which extends across a rectangular opening 48. Each buckle 46 is secured to the pad 32 by a short length of strap 49 extending through the buckle 46 and over the cross piece 47 and having the ends of the same secured by st itching 51 to the pad 32. The strap 13 also extends through the buckles 46 over the strap 49 and the cross piece 47 to hold the extremities of the pad 32 in alignment with the strap 13. Use of the buckles 46 permits the pad to be adjusted longitudinally of the strap 13 to the desired position.

A cross member assembly 61 is provided which forms a part of the device 11 and cooperates with the strap assembly 12 as hereinafter described. The cross member assembly 61 consists of an elongate flexible strap 62 formed of the same material as the strap 13 and has a suitable length as for example 4 feet. The strap is provided with ends 62*a* and 62*b* which are fastened together by buckle means 64 of the same type as buckle means 14. The buckle means 64 is provided with a male part 66 and a female part 67 corresponding to the male part 16 and the female part 17 of buckle means 14 as well as a buckle 69 corresponding to the buckle 23. As can be seen from FIG. 6, the cross member assembly 61 forms an endless loop which encircles the two sides of the strap assembly 12. Means such as tubes attached to the cross member 61 and slidable on the strap 13 and other attaching or tensioning devices can be provided for positioning the cross member at the desired location along the length of the strap 13.

The use and operation of the device 11 in accordance with the method of the present invention may now be briefly described as follows.

Figure 1:
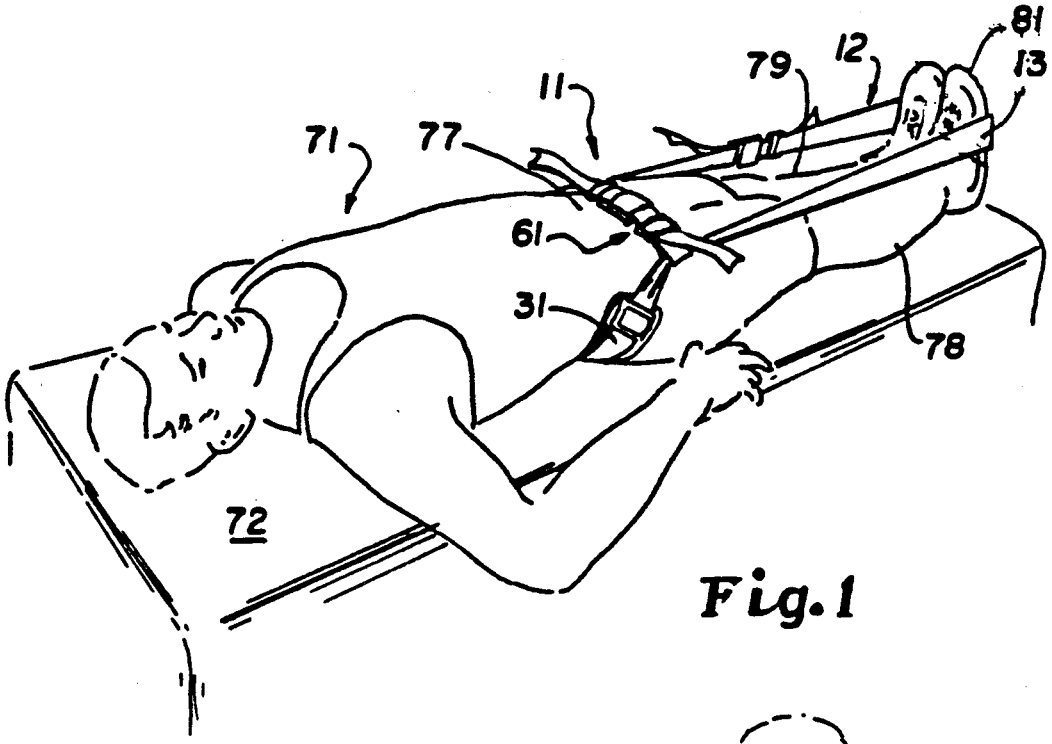
FIG. 1 is a perspective view showing the device for decompressing the spine of a human being being utilized on a human being in a supine position.

In FIG. 1, the device 11 is shown being used on a human being 71 is a supine face-up position on a couch 72. The human being is provided with a spine (not shown) extending up the patient's back. The patient is provided with a lower back 76, abdomen 77, legs 78, knees 79 and feet 81.

In using the device, the patient or an assistant places the device 11 on a couch 72 or on a floor or other flat surface in such a manner so that the pad assembly 31 is open and so that the strap 13 extends downwardly from both sides of the same until its extremity is adjacent the foot of the couch 72. The patient then lies down on the couch with his lower back positioned over the pad assembly 31. The cross member assembly can then be slipped over the lower extremity of the strap 13, or alternatively the buckle means 64 can be opened and the strap 62 looped around the two sides of the strap 13. The cross member assembly 61 is then adjusted to the appropriate length by utilization of the buckle 69 by pulling the strap 62 therethrough so that the appropriate length is achieved. Thereafter the feet of the patient 81 can be placed in the lower extremity of the strap 13 to ascertain whether or not the strap assembly 12 is of an appropriate length. The buckle means 14 can then be adjusted to achieve the desired length so that the strap assembly 12 is relatively taut when the legs of the patient 78 are extended or straight and lie in a plane generally parallel to the top of the couch 72. When the device 11 is positioned in this manner it can be seen that the pad assembly 31 is disposed in the small of the back of the human being right above the iliac crests. The cross member assembly 61 is disposed opposite the pad assembly 31 across the abdomen of the human being so that the pad assembly 13 and the cross member assembly 61 generally encircle the waist of the human being at the lower back. The strap 13 preferably extends from the cross member assembly down the sides of the human being and over the balls of the feet of the human being so that the calves of the legs and the hamstrings are directly affected when pressure is applied by the feet to tighten the strap 13 to apply a pulling force to the lower portion of the back of the human being. In the use shown in FIG. 1, the strap 13 is partially at the front of the user and as used in FIGS. 4 and 11, to be described below, is positioned, respectively, partially at the back or along the side of the user.

The length of the strap 13 is adjusted so that when the legs are straightened, tensioning forces will be applied to the belt. Thus, the strap assembly 12 should be lengthened or shortened until the proper length is achieved.

Typically, one experiencing a low back pain would utilize the device in the position shown in FIG. 1 by lying on his back for approximately 3–5 minutes and then by pressing one foot and then another into the strap or belt 13. When the strap 13 is tightened, traction is placed on the spine and at that same time stretching of the posterior leg muscles will occur. In addition, isometric contraction of soleus muscles, the hamstrings and reciprocal stretching of the quadriceps will occur. Thus it can be seen that a number of leg muscles are being utilized in order to place traction on the lower lumber and also on the sacrum of the human being. When a patient has centralized low back pain in the midback both feet can be utilized to engage the strap 13 as shown in FIG. 1.

Typically, 3–5 minute's use of the device either before or after exercising may be adequate to achieve the desired results. However, if severe back pain continues, use of the device can be continued for longer periods of time. If need be, the human being can utilize the device at periodic intervals, as for example as often as six times a day without creating problems. If a human being has leg pain, it has been found that the device 11 used in the manner shown in FIG. 1 can be utilized for decreasing that pain particularly if that one side having leg pain is stretched by utilizing the foot of that leg experiencing the pain for engaging the strap 13.

It has been found that human beings having consistent microtrauma of their spines such as by lifting or sitting for long periods of time, can utilize the device of the present invention on a daily basis for 3–5 minutes every morning or every evening whichever is more suitable for the human being. However, the evenings are preferred so that the human being can sleep more soundly because of the softening of the muscles caused by the stretching resulting from using the device of the present invention.

Figure 2:
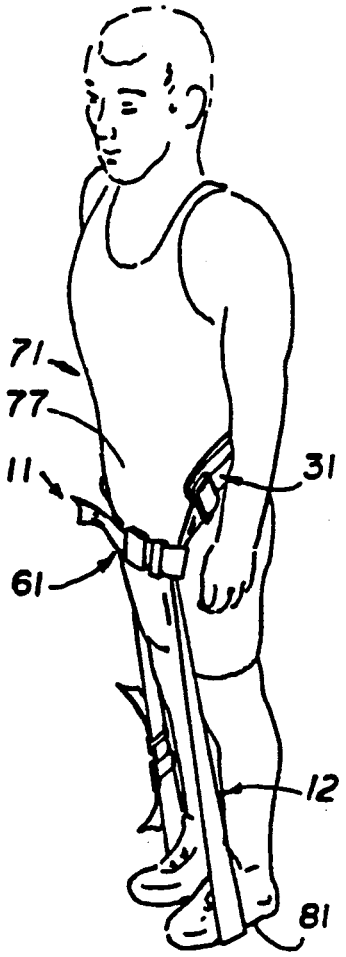
FIG. 2 is a perspective view showing the device of the present invention being utilized on a human being in a standing position.

In FIG. 2 there is shown another position for use of the device 11 in which the human being 71 assumes a standing position. The pad assembly 31 is in the small of the back at the base of the lumbars with the cross member assembly 61 extending across the abdomen 77 to encircle the waist at the lower back. The straps extend downwardly from the cross member 61 along both sides of the body and over the anterior parts of the balls of the feet. The human being in a standing position tightens the strap 13 to a position that creates enough tension to provide traction in the small of the back and also in the sacrum.

The repetition rate of the use of the device can be the same as hereinbefore described for use of the device in the supine position as shown in FIG. 1. Use of the device in the standing position as shown in FIG. 2 is advantageous in situations where there is inadequate horizontal space, as for example floor space or couch or table space. Such is often the case in airplane travel in which a human being having severe back problems can utilize the device in a standing position as shown in FIG. 2. However it is believed that the supine position is preferable because it is easier for the human being to create the stretching when lying on his or her back.

In entering the device 11 as shown in FIG. 2, the pad assembly 31 would preferably placed in the small of the back. The human being would then bend his knees and at that time would place the cross member 61 in front of the pelvic region or over the top of the thighs. The strap 13 is then brought to the floor so that the human being can step on them. At that time the human being can straighten up slowly while maintaining a slight curve in the small of the back and then straightening the knees.

Figure 3:
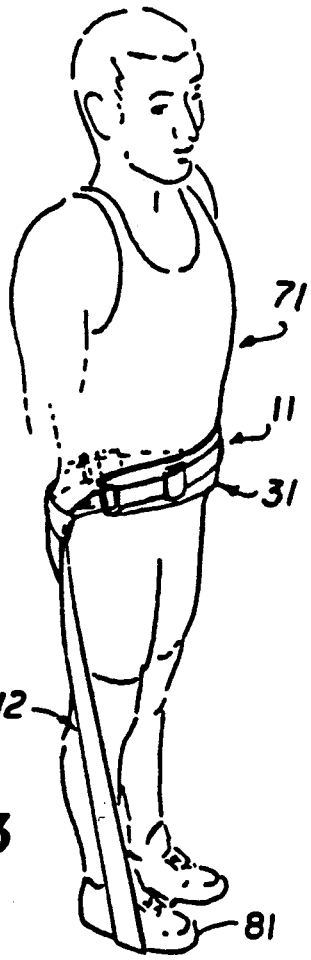
FIG. 3 is another perspective view of the device of the present invention shown in a different position on a human being in a standing position.

In FIG. 3 the device 11 is shown also being utilized in the standing position, however with the pad assembly crossing over the abdomen and with the cross member assembly 61 extending across the small of the back with the strap 13 extending below the balls of the feet of the human being. Exercises can be accomplished in a vertical position to relieve back pain and to stretch numerous muscles in the legs of the human being.

In FIG. 4, the device 11 is shown being used by a human being in the prone or supine position lying face down on a couch 72. The padded part of the belt or, in other words, the pad assembly 31 underlies the abdomen of the patient with the cross member 61 extending across the small of the back of the human patient with the straps 13 extending down the legs of the human being to the balls of the feet 81 of the human being. Using the feet 81 to tension the strap 13 causes a greater pulling on the front of the body by causing pulling on the anterior superior iliac spine to cause a different type of traction than that which occurs when the device is used in the position shown in FIG. 1. Thus the human being can select the position in which the device is to be used depending upon whether that human being needs more pull in the lumbars with more extension rather than more of a forward flexion.

In utilizing the device of the present invention the lower back of the human being is maintained in a constant neutral and stable position while permitting a safe strong stretching format addressing the individual needs of the human being. With alternative flexion and extension (one foot at a time at the ankle) the sacral-iliac joints are mobilized. The lumbar spine of the human being can be specifically mobilized depending upon the positioning of the cross member 61 in the anterior aspect of the body of the human being. The specific lumbar vertebrae can be influenced by positioning the cross member 61 so it is directly opposite the lumbar vertebrae to be affected. The dural tube is mildly affected due to the sacrum being in extension. During mobilization of the lumbar spine, the foramina are widened, the fasciae joints are separated, the vertebral spaces are decompressed to cause a reduction in pain, inflammation and muscle spasms.

The effects of the device of the present invention also causes stretching of numerous muscles throughout the body of the human being, primarily the following muscles: gastrocnemius, hamstrings, quadriceps, psoas, abdominal, erectors spinae muscles, quadratus lumborum and hip flexors. Also there is reciprocal inhibition of the quadriceps and dorsal flexion of the ankle or ankles.

In FIG. 5, there is shown another position in which the device 11 of the present invention can be utilized. The device is entered in a manner similar to that shown in FIG. 1 in which the device with the pad assembly 31 is positioned on the table or couch 72 with the patient assuming a prone face-down position lying upon the pad assembly 33 and then placing the cross member assembly 61 over the straps 13 and then adjusting the lengths of the straps so that they go around the knees 79 of the human being rather than the feet of the human being. Thus the strap assembly 12 is shortened substantially. The strap 13 is then tightened below the knees of the patient below the patellas and on both sides of the tibias. By tightening the strap 13 appropriately, a tension can be placed upon the lower back of the patient. The sacroiliacs can then be mobilized by slightly rotating the knees back and forth on the spine of the patient as indicated by the arrow 86 in FIG. 5. The amount of rotation utilized by the human being is determined by the comfort level by the patient. Thus rotation up to nearly 180 degrees can be achieved after repeated use of the device which can extend over a period of time, as for example 20 to 30 days with some exercise taking place every day or every other day. Utilization of a device in the position shown in FIG. 5 involves the hip flexors as well as the tensor fasciae latae. The quadriceps are mildly involved. The gluteus maximus and the puriformus are contracted. Also involved are the abdominal muscles, the soleus muscles as well as the quadratus lumborum.

DESCRIPTION OF OTHER EMBODIMENTS

Figure 9:
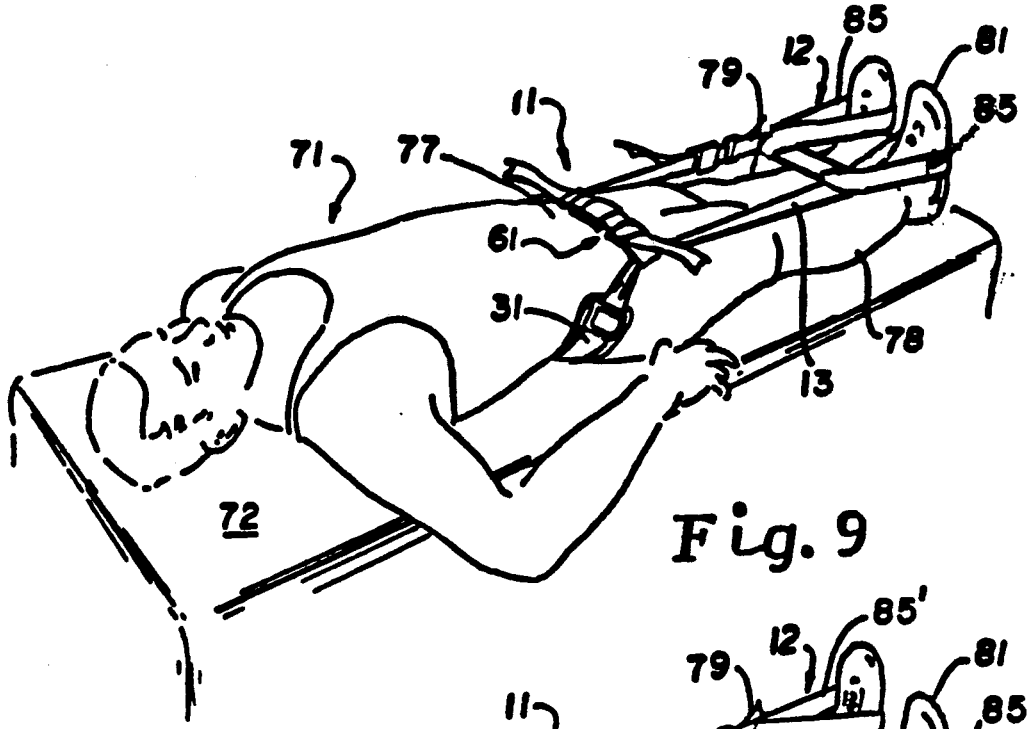
FIGS. 9, 10 and 11 illustrate alternative embodiments of the present invention.

As an alternative embodiment of the present invention, separate foot loops can be provided to receive the individual feet of the wearer. In accordance with one alternative embodiment shown in FIG. 9, individual foot loops 85 are provided which are looped around the strap 13. This construction avoids the problem encountered in the preferred embodiment of having the wearer's feet pressed sideways together in the lower extremity of the strap 13 when pressure is applied by the feet side by side against the loop strap 13. However, in the embodiment shown in FIG. 9 there is less ability on the part of the wearer to apply force with first one leg and then the other and have the pad assembly 31 apply a torsional force to the lower back of the wearer. The ability to apply torsional force could be enhanced by fixing the foot loops 85 to the belt 13 instead of merely looping the foot loops 85 through the belt loop 13.

Figure 10:
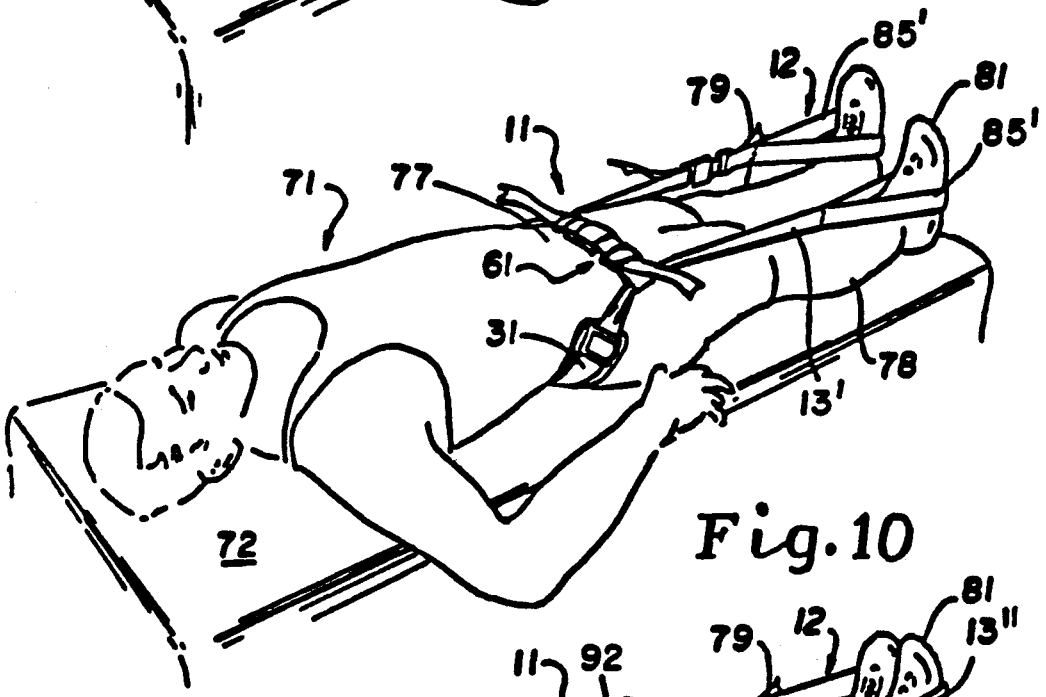

In accordance with another alternative embodiment of the invention shown in FIG. 10, the strap 13', instead of being in a closed loop, could be opened at the end and a second loop 85' provided for each foot of the wearer. With individual foot loops 85' connected to the ends of the strap 13' there is a stirrup type structure for each foot. In this embodiment if the buckles 46 are modified to be similar to flaps 38 and 39 to retain strap 13 fully slidable thereunder, a single length adjustment could be used for the strap 13. With this embodiment the wearer does not get the concerted action of the wearers two feet operating together side by side within a closed loop.

Figure 11:
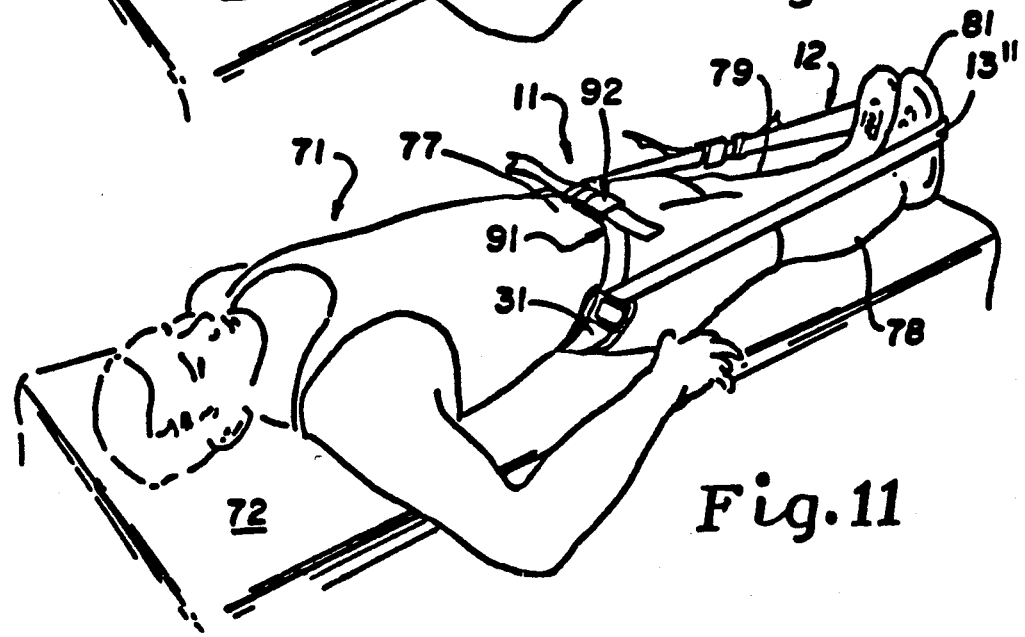

In accordance with still another embodiment of the present invention as shown in FIG. 11, the cross member assembly 61 can be integrated with the portion of the strap 13 that at least partially encircles the body of the wearer so that a belt shaped strap 91 provided with the waist pad 31 and a waist adjustment buckle 92 is provided having a leg loop strap 13'' connected to the belt and providing the loop to hold the feet of the wearer. Alternatively, the leg loop strap 13'' can take the form of a closed loop which is looped over the belt shaped strap 91. This embodiment can also include the additional foot straps of FIG. 9 or the individual stirrup type straps of FIG. 10.

From the foregoing it can be seen that there has been provided a device which is relatively simple and economical to manufacture and which can be readily used by an individual human being without the necessity of help from others. Because of its construction, it can be folded up into a compact unit for shipment and storage. Almost immediate results can be achieved upon utilizing the device for relieving lower back pain and for relieving pain in tired and aching muscles. Thus the device of the present invention can be utilized for correcting, alleviating and preventing mechanical changes in the lower back of a human being that produce pain symptoms and to provide immediate relief to athletes and others who experience tightness or mild discomfort in their muscles after physical activity.

What is claimed is:

1. A device for decompressing the spine of the body of a human comprising:

a flexible elongate strap means adapted to encircle a portion of the waist of the human for engaging either a front or back portion of the human and having a sufficient length for extending along opposite sides of the body of the human and adapted to be engaged by a portion of the legs of the human below the knees, a flexible pad assembly positioned on said strap means to be disposed on either said front or back portion and conform to the shape of said either said front or back portion of the human when in use, and a flexible strap cross member adapted to be slidably disposed on the front or back side of the human opposite said pad assembly and for contact with the body of the human above the knees, which functions to engage opposite extending portions of said flexible elongated strap means to vary the relative distance between them, said elongate strap means and said cross member being adjustable in length, whereby with said elongate strap means and said cross member encircling the body of the human and with a force applied by a portion of the legs of the human under the knees, traction is placed upon the spine of the body of the human for decompressing the spine.

2. A device as in claim 1 wherein said strap means forms a closed loop.

3. A device as in claim 1 including a pair of loops engaging said strap means for receiving the feet of the human.

4. A device as in claim 1 wherein said strap means includes a pair of straps each of which includes a loop for engagement and stretching by at least one foot of the human.

5. A device as in claim 1 wherein said cross member is slidably mounted on said elongate strap means.

6. A device for decompressing the spine of the body of a human comprising:

a flexible elongate strap adapted to encircle a portion of the waist of the human and forming a closed loop for engaging the lower back of the human and having a sufficient length for extending along opposite sides of the body of the human and adapted to be engaged by a portion of the legs of the human below the knees, a flexible pad assembly positioned on said elongate strap to be disposed on the back and conform to the shape of the back of the human when in use, and a flexible cross member slidably mounted on said elongate strap and disposed on the front side of the human being opposite said pad assembly and in contact with the body of the human above the knees which functions to engage opposite extending portions of said flexible elongated strap means to vary the relative distance between them, said elongate strap and said cross member being adjustable in length, wherein with said elongate and said cross member strap encircling the body of the human and with a force applied by a portion of the legs of the human under the knees, traction is placed upon the spine of the body of the human for decompressing the spine.

7. A device as in claim 6 including a pair of loop straps engaging said elongate strap whereby each loop strap can receive at least one foot of the human.

* * * * *